US008128353B2

(12) United States Patent
Flanagan et al.

(10) Patent No.: US 8,128,353 B2
(45) Date of Patent: Mar. 6, 2012

(54) METHOD AND APPARATUS FOR MATCHING THE THERMAL MASS AND STIFFNESS OF BOLTED SPLIT RINGS

(75) Inventors: Mark W. Flanagan, Greenville, SC (US); Christopher P. Cox, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1003 days.

(21) Appl. No.: 12/285,242

(22) Filed: Sep. 30, 2008

(65) Prior Publication Data

US 2010/0080698 A1 Apr. 1, 2010

(51) Int. Cl.
*F01D 25/14* (2006.01)
*F01D 25/28* (2006.01)

(52) U.S. Cl. ..... 415/182.1; 415/215.1; 415/214.1; 415/13

(58) Field of Classification Search ..... 415/214.1, 415/215.1, 182.1, 177, 220, 134
See application file for complete search history.

(56) References Cited

U.S. PATENT DOCUMENTS 4,412,782 A * 11/1983 Monsarrat ..... 415/175
5,063,661 A * 11/1991 Lindsay ..... 29/888.02
5,605,438 A * 2/1997 Burdgick et al. ..... 415/182.1
6,352,404 B1 * 3/2002 Czachor et al. ..... 415/116
6,691,019 B2 * 2/2004 Seeley et al. ..... 701/100

* cited by examiner

*Primary Examiner* — Benjamin Sandvik
*Assistant Examiner* — Joseph Schoenholtz
(74) *Attorney, Agent, or Firm* — Nixon & Vanderhye P.C.

(57) ABSTRACT

A method and apparatus for controlling distortion in the casing of a gas turbine are disclosed. The method uses a split in the flange ID underneath "false" flanges to tune the hoop stiffness of the casing to match the stiffness and behavior of the bolted joint. By matching the hoop carrying capability and load path of the split-line flange, as well as the thermal mass effect, the distortion can be channeled to a higher order distortion mode that can evenly distribute the deflection and approach a pure circular form.

20 Claims, 3 Drawing Sheets

METHOD AND APPARATUS FOR MATCHING THE THERMAL MASS AND STIFFNESS OF BOLTED SPLIT RINGS

The present invention relates to gas turbines, and more particularly, to a method and apparatus for controlling distortion in the casings of gas turbines.

BACKGROUND OF THE INVENTION

In the gas turbine industry, a common problem with structural turbine casings is distortion of the casing, e.g., out-of-roundness, caused by the response of the casing to various temperature and pressure conditions during turbine operation. Gas turbines undergo rapid thermal transient loading during normal operation that produce large thermal gradients in the casing structures. If the thermal mass distribution is non-homogeneous around the casing, then there will be a resultant distortion from the intended circular shape.

Typical turbine and compressor housings are formed in upper and lower halves connected one to the other along a horizontal plane by vertical bolts extending through radially outwardly directed and enlarged flanges at the housing split-line. These split-wall casings with large flanges running down the split-line joint result in a thermal mass concentration that can result in casing distortion during a thermal transient event. One reason for the casing to distort is that the mass of the splitline flange is large, causing it to respond thermally at a rate slower than the response time for the balance of the turbine housing. Coupled with this large mass is a large thermal gradient through the flange which causes the flange to pinch inwards due to thermally induced axial strain.

Distortion is a large component of setting stage 1 and 2 turbine clearances, which can be the most sensitive in the machine, and generally affect efficiency and output to the largest degree. Current gas turbines have large distortions during transient operations, which are generally the worst on a hot restart, and clearances are generally opened on a one-for-one basis to account for distortion, directly impacting steady state clearances. This type of distortion is an important component to setting steady state clearances for the stage 1 turbine rotor, and tighter clearances result in improved gas turbine operability and performance.

Additional distortion can result from the hoop load discontinuity at a split-line of a multi-piece casing. The total resulting distortion from the ideal circular shape is one factor in determining the minimum clearance between rotating and stationary parts, as the rotating parts can not expand beyond the minimum radius of the casing, even if this minimum radius exists over a very small portion of the casing. In order to provide for tighter clearances, the casing should be as circular as possible whenever the clearances are small. Minimum tip clearance results in less leakage of working fluid over the tip of the blade/vane which yields the highest efficiency operation of the gas turbine.

Another cause of distortion is a result of internal casing pressure. Further, it will be appreciated that there is an offset between the centerline of the bolt holes and the main portion of the turbine casing at the split-line flanges. Because of this offset, a moment is introduced by the hoop field stress transferred through the bolts, causing the split-lines to deflect radially inwardly.

To mitigate distortion, sometimes "false" flanges are used to provide additional thermal mass at other circumferential locations on the casing. U.S. Pat. No. 5,605,438 ("the '438 patent") discloses casings for rotating machinery, such as turbines and compressors, which significantly reduces distortion and out-of-roundness through the use of "false" flanges. The '438 patent discloses a turbine casing that is provided with a strategically located circumferential rib and a plurality of axially extending flanges. The '438 patent also discloses a compressor casing that is provided with only a plurality of axially extending flanges. The entire contents of the '438 patent are incorporated herein by reference.

FIG. 1, which corresponds to FIG. 3 of the '438 patent, illustrates a generally semi-cylindrical turbine casing half 40 that mates with a similar semi-cylindrical casing half (not shown) at horizontal split-line flanges 42 by bolts in radially split bolt holes (not shown). To reduce the distortion of the turbine casing caused by internal pressure and to control the thermal response of the turbine during start-up and shut-down, each of the mating casing halves 40 is provided with a circumferentially extending rib 44. Rib 44 extends about each half of the cylindrical turbine casing between opposite ends thereof, terminating at its ends just short of the split-line flanges 42. By locating the rib 44 circumferentially about the semi-cylindrical halves, the distortion of the casing half caused by internal pressure is significantly reduced. Additionally, one or more axially extending flanges 46 are provided in each of the semi-cylindrical casing halves 40. As illustrated in FIG. 1, the casing half 40 is provided with three axially extending ribs 46 that are spaced circumferentially one from the other around casing half 40. These ribs 46 substantially match the stiffness and much of the thermal mass of the horizontal split-line flange 42. Because flange 42 has slots which run from the bolt hole to the outside surface of the flange, there is a reduction in strain in flange 42 which enables the axially extending ribs 46 to be designed smaller than the horizontal flange 42, i.e., the axial ribs 46 are not as massive as the split-line flanges 42. Because the split-line flanges 42 have the slots, the stiffness is reduced in a radial direction. The '438 patent teaches that only the radial stiffness of the split-line flanges 42 needs to be matched.

FIG. 2, which corresponds to FIG. 4 of the '438 patent, illustrates one half of a compressor casing in the form of a semi-cylindrical half 50 that mates with a similar semi-cylindrical compressor casing half (not shown) at horizontal split-line flanges 54. The compressor casing half 50 does not include a circumferentially extending rib because of a lack of significant thermally induced stresses in the compressor casing. However, one or more axially extending flanges are provided at circumferentially spaced positions about the housing half, similar to the turbine casing half 40 discussed above. The same considerations with regard to stiffness and the reduction in the size or mass of the axially extending flanges 52, as discussed above with respect to the axial flanges of the turbine casing 40, are applicable.

"False" flanges, similar to flanges 46 and 52 shown in FIGS. 1 and 2, have been used extensively, but they do not solve all distortion problems. They only address the thermal mass effect. The hoop stiffness under each of the "false flanges" does not match that at the split line due to the bolted joint stiffness discontinuity at, say, split-line flanges 42 shown in FIG. 1. It should be noted that the number of false flanges, such as flanges 46 and 52 shown in FIGS. 1 and 2, can be more than two in number.

BRIEF DESCRIPTION OF THE INVENTION

In an exemplary embodiment of the invention, a cylindrical casing used in a turbine in which distortion is controlled comprises a semi-cylindrical upper casing half, the upper casing half having first and second upper split-line flanges extending generally radially from and horizontally along diametrically opposite ends of the upper casing half, a semi-cylindrical lower casing half, the lower casing half having first and second lower split-line flanges extending generally radially from and horizontally along diametrically opposite ends of the lower casing half, the first and second upper split-line flanges being joined to the first and second lower split-line flanges, respectively, to thereby join the upper and lower casing halves to one another to form the housing, a first false flange extending generally radially from and horizontally along a side of the upper casing half, and a second false flange extending generally radially from and horizontally along a side of the lower casing half, each of the first and second false flanges including a split in the flange's inner diameter so as to allow the housing's hoop stiffness to be adjusted to match the hoop stiffness of bolted joints in the split-line flanges and the ability of the split-line flanges to bear a hoop load or hoop force.

In another exemplary embodiment of the invention, a turbine housing in which distortion is controlled comprises a semi-cylindrical upper casing half, the upper casing half having first and second upper split-line flanges extending generally radially from and horizontally along diametrically opposite ends of the upper casing half, a semi-cylindrical lower casing half, the lower casing half having first and second lower split-line flanges extending generally radially from and horizontally along diametrically opposite ends of the lower casing half, the first and second upper split-line flanges being bolted to the first and second lower split-line flanges, respectively, to thereby join the upper and lower casing halves to one another to form the housing, and first and second false flanges spaced diametrically opposite one another on the housing, the first false flange extending generally radially from and horizontally along a side of the upper casing half, the second false flange extending generally radially from and horizontally along a side of the lower casing half, each of the first and second false flanges including a split in the flange's inner diameter so as to allow the housing's hoop stiffness to be adjusted to match the hoop stiffness of bolted joints in the split-line flanges and the ability of the split-line flanges to bear a hoop load or hoop force.

In a further exemplary embodiment of the invention, a method of controlling distortion in a cylindrical casing used in a gas turbine comprises the steps of providing a semi-cylindrical upper casing half with first and second upper split-line flanges extending generally radially from and horizontally along diametrically opposite ends of the upper casing half, providing a semi-cylindrical lower casing half with first and second lower split-line flanges extending generally radially from and horizontally along diametrically opposite ends of the lower casing half, joining the first and second upper split-line flanges to the first and second lower split-line flanges, respectively, to thereby join the upper and lower casing halves to one another to form the cylindrical casing, providing a first false flange extending generally radially from and horizontally along a side of the upper casing half, providing a second false flange extending generally radially from and horizontally along a side of the lower casing half, and providing in each of the first and second false flanges a split in the flange's inner diameter to thereby adjust the housing's hoop stiffness to match the hoop stiffness of bolted joints in the split-line flanges and the ability of the split-line flanges to bear a hoop load or hoop force.

DETAILED DESCRIPTION OF THE INVENTION

In one embodiment of the invention, distortion in a turbine casing is controlled by providing splits in the flange inner diameter underneath false flanges on the casing. By providing splits in the flange inner diameter underneath the false flanges, the hoop stiffness of the casing can be "tuned" to match the hoop stiffness of the bolted joints in split-line flanges between semi-cylindrical upper and lower casing halves, and thus, the ability of the false flanges to bear a corresponding hoop load or hoop force. By matching the hoop stiffness and hoop load capability of the split-line flanges, as well as the thermal mass effect of these flanges in the false flanges, the distortion in the casing can be channeled to a higher order distortion mode that can evenly distribute the deflection and thereby allow the casing to approach a more pure circular form.

Figure 1:
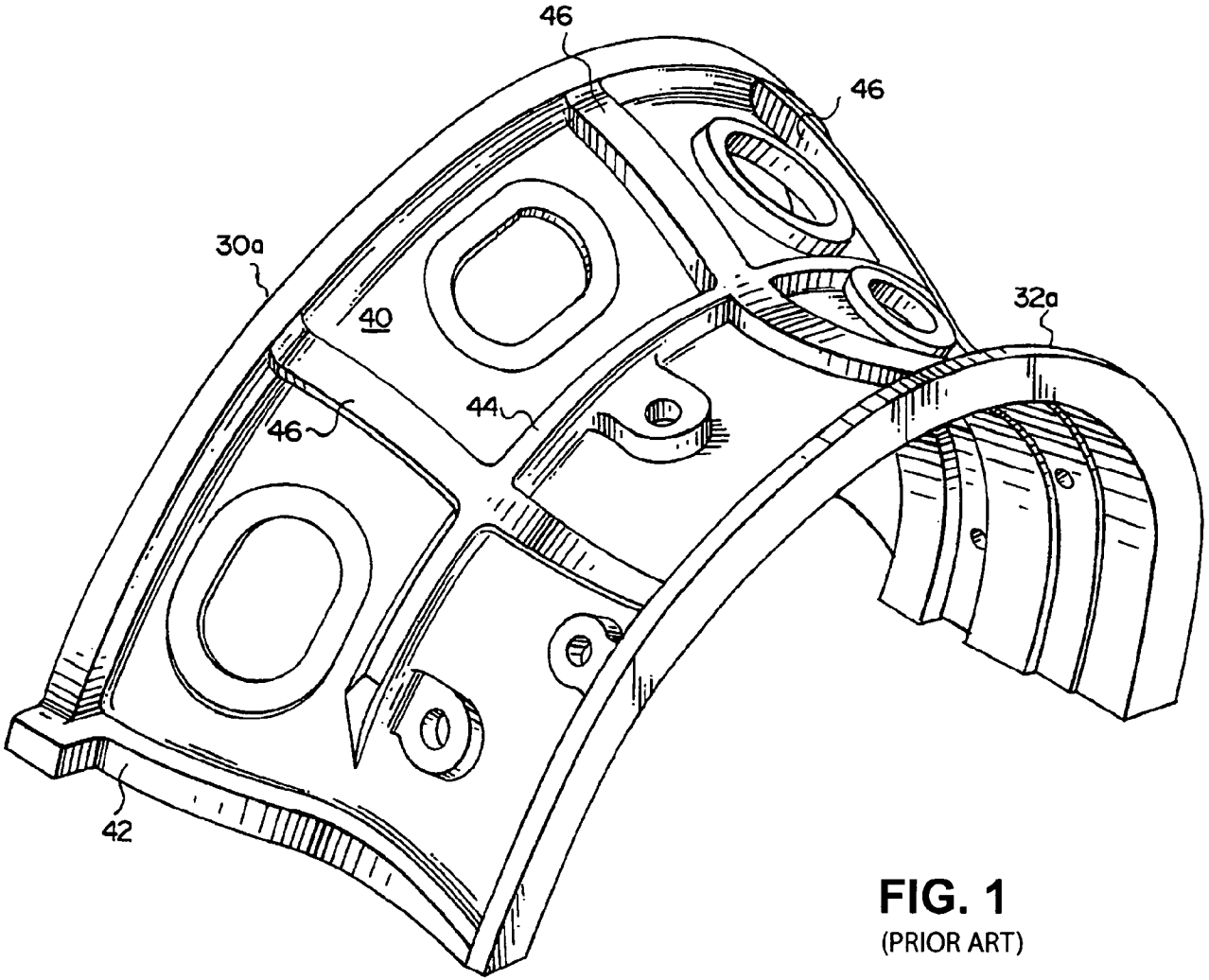
FIG. 1 (PRIOR ART)
FIG. 1 is a perspective view of a prior art generally semi-cylindrical turbine casing half that has been provided with a circumferentially extending rib and a plurality of axially extending flanges that are spaced circumferentially one from the other to mitigate casing distortion.
Figure 2:
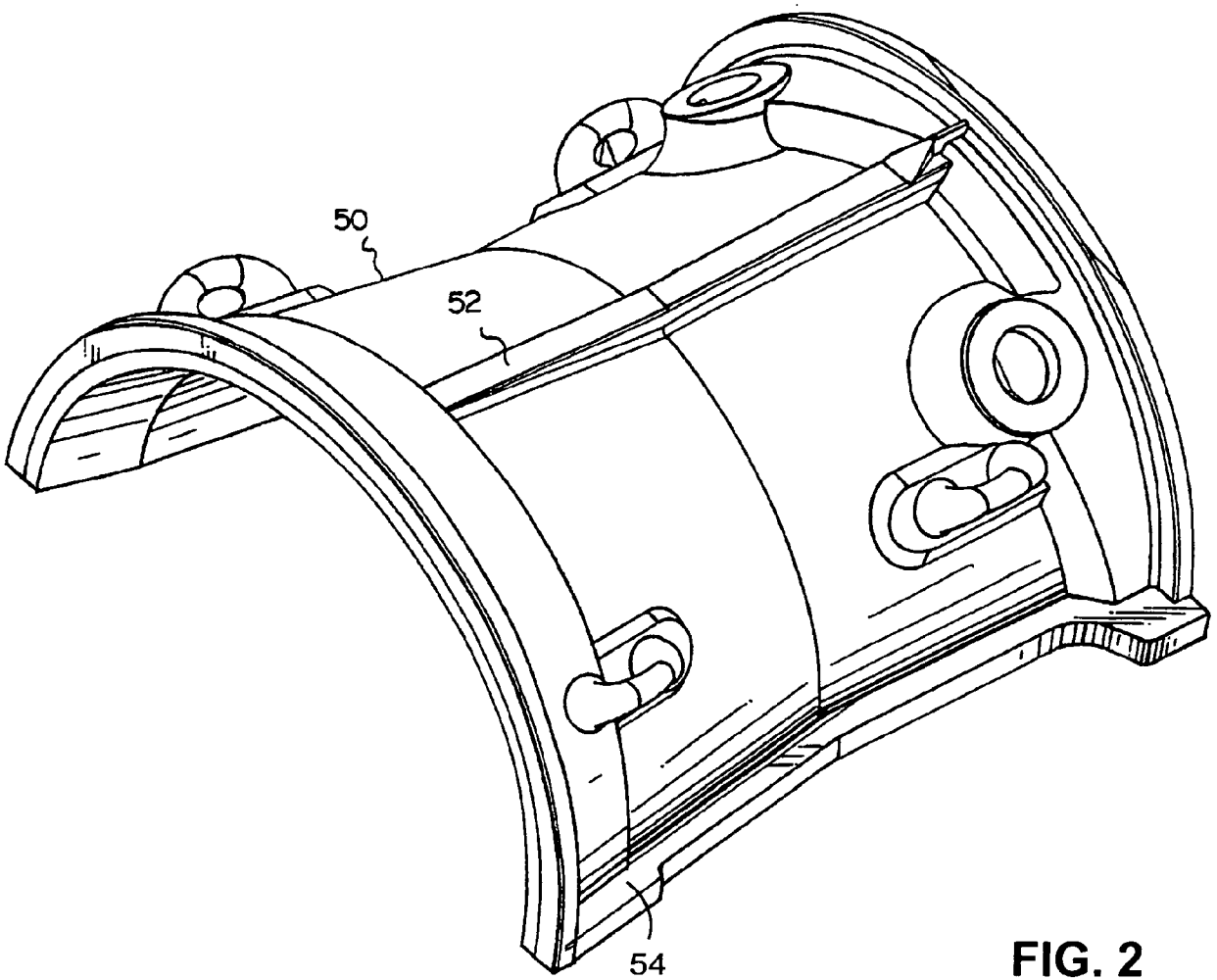
FIG. 2 (PRIOR ART)
FIG. 2 is a perspective view of a prior art generally semi-cylindrical compressor casing half that has been provided with a plurality of axially extending flanges that are spaced circumferentially one from the other to mitigate casing distortion.
Figure 3:
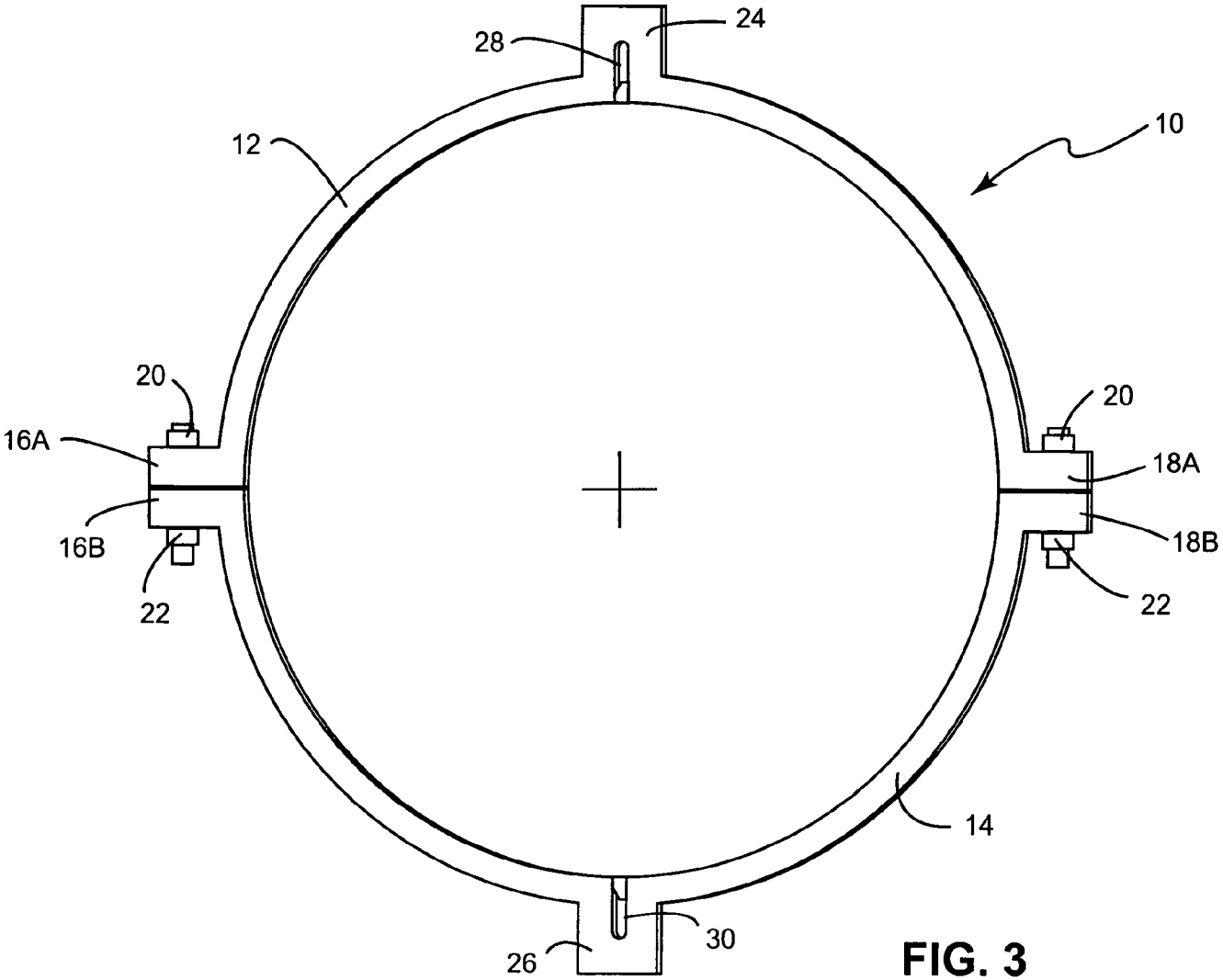
FIG. 3 is a cross-sectional view of a generally cylindrical gas turbine casing exemplifying a method and apparatus for controlling distortion in the casing by providing splits in the flange inner diameter underneath "false" flanges spaced diametrically opposite one another on the turbine casing.

FIG. 3 is a cross-sectional view of a gas turbine casing (or compressor casing), shown as a generally cylindrical housing 10 in which shrouds (not shown) for various turbine stages (not shown) are suitably mounted, and in which rotating parts (not shown) of a turbine, such as the turbine buckets and rotor, rotate. The housing 10 comprises semi-cylindrical upper and lower casing halves 12 and 14. Upper casing half 12 has flanges 16A and 18A extending generally radially from diametrically opposite ends of upper casing half 12. Lower casing half 14 also has flanges 16B and 18B extending generally radially from diametrically opposite ends of lower casing half 14. Flanges 16A and 18A and flanges 16B and 18B also extend generally horizontally along diametrically opposed sides of the cylindrical halves 12 and 14. Flanges 16A and 18A are joined to corresponding flanges 16B and 18B, respectively, to thereby join the casing halves 12 and 14 to one another to form housing 10. Preferably, flanges 16A and 18A are bolted to corresponding flanges 16B and 18B using bolts 20 and nuts 22, although it should be noted that other methods of joining such flanges together, other than bolting, could be used. For example, flanges 16A and 18A and flanges 16B and 18B could be clamped, or welded on the exterior surface, or some other form of joint that does not provide hoop continuity at the same radius as the inner diameter of the housing casing 10. The actual method of joining the casing halves 12 and 14 is irrelevant to the present invention, except to the extent that a particular joining method results in a constant radius load path around the circumference of housing casing 10.

Also shown in FIG. 3 are two "false" flanges 24 and 26 that are spaced diametrically opposite one another on housing 10 and that extending generally radially from and horizontally along the sides of casing halves 12 and 14, respectively. It should be noted that more than two flanges, like flanges 24 and 26, separated from one another along the circumference of housing 10, could also be used. Thus, the false flanges 24 and 26 do not necessarily have to be diametrically opposite one another. An example with three flanges 120° apart would still be effective for some geometries.

False flanges 24 and 26 are sized and/or dimensioned to substantially match the stiffness and the thermal mass of the split-line flanges 16A/B and 18 A/B. It should be noted, however, that, where each of the split-line flanges have a slot that runs from a bolt hole to an outside surface of the split-line flange, so that there is a reduction in strain in the split-line flange, the false flanges 24 and 26 could be designed to be smaller in mass than the split-line flanges 16A/B and 18A/B. That is, the axial false flanges 24 and 26 would not be as massive as the split-line flanges 16A/B and 18A/B. It should be noted, however, that the radial 'sawcuts' in the split-line flanges 16A/B and 18 A/B are not directly relevant to the present invention, in that they can be used in conjunction with the invention, but are not required. The splits under the false flanges, such as splits 28 and 30 under false flanges 24 and 26, are present to "tune" the hoop stiffness of housing 10. The size and mass of false flanges 24 and 26 are intended to match the thermal response rate of housing 10, which is a different problem. The splits would still effective if the false flanges 16A/B and 18 A/B are of a differing size and mass from the split line flanges 24 and 26.

The cross-sectional view of FIG. 3 Exemplifies the method of the present invention for controlling distortion in a turbine casing, such as housing 10. According to the method, splits, such as splits 28 and 30 shown in FIG. 3, are provided in the flange inner diameter underneath false flanges 24 and 26. Providing splits 28 and 30 in the flange inner diameter underneath false flanges 24 and 26, respectively, allow the hoop stiffness of housing 10 to be adjusted or "tuned" so as to match the hoop stiffness of the bolted joints in split-line flanges 16A/B and 18A/B, and the ability of these split-line flanges to bear a corresponding hoop load or hoop force.

"Stiffness" measures the elastic response of an object to an applied load. "Hoop stiffness" is the hoop force per unit length required to elastically change the diameter of a cylindrical object, like a turbine casing. "Hoop force" or "hoop load" is the force acting circumferentially in an object subjected to internal or external pressure.

Flanges 16A/B and 18A/B have a predetermined hoop stiffness and load path. By providing splits 28 and 30 in false flanges 24 and 26, the flanges 24 and 26 are caused to have a hoop stiffness and load path substantially the same as that of the split-line flanges 16A/B and 18A/B. By matching the hoop stiffness and load path of the split-line flanges, as well as the thermal mass effect of these flanges in the false flanges 24 and 26, the distortion in housing 10 can be channeled to a higher order distortion mode that can evenly distribute the deflection and thereby allow housing 10 to approach a more pure circular form.

The shape of the splits 28 and 30 in the false flanges 24 and 26 is not restricted. A straight channel as shown in FIG. 3 could be used, as could some form of 'keyhole' shape, but the required characteristics of the splits are a matching of hoop stiffness and radius of load path for the false flanges 24 and 26. Mass or dimensional matching go toward matching transient thermal response rate, and are not related to this mechanical matching.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A casing in which distortion is controlled, the casing comprising:

an upper casing half having first and second upper split-line flanges extending from the upper casing half, a lower casing half having first and second lower split-line flanges extending from the lower casing half, the first and second upper split-line flanges being joined to the first and second lower split-line flanges, respectively, to thereby join the upper and lower casing halves to one another to form the casing, and a plurality of false flanges extending from the upper and lower casing halves, each of the plurality of false flanges including a split in the false flange's inner diameter so as to allow the casing's hoop stiffness to be adjusted to match the split-line flanges' hoop stiffness and the radius of the load path of the split-line flanges.

2. The casing of claim 1, wherein the split in each of the false flanges has a shape that allow the casing's hoop stiffness to be adjusted to match the split-line flanges' hoop stiffness and the radius of the load path of the split-line flanges.

3. The casing of claim 2, wherein the shape of the split in each of the false flanges is either a straight channel or a keyhole shape.

4. The casing of claim 1, wherein each false flange is positioned circumferentially on the casing so that the false flanges and the split-line flanges are spaced equally apart around the casing.

5. The casing of claim 1, wherein each false flange is sized and/or dimensioned to substantially match the stiffness and thermal mass of the first upper and lower split-line flanges together and/or the second upper and lower split-line flanges together.

6. The casing of claim 1, wherein the plurality of false flanges are positioned symmetrically around the casing.

7. The casing of claim 1, wherein the plurality of false flanges are positioned asymmetrically around the casing.

8. A cylindrical casing in which distortion is controlled, the casing comprising:

a semi-cylindrical upper casing half having first and second upper split-line flanges extending generally radially from opposite ends of the upper casing half, a semi-cylindrical lower casing half having first and second lower split-line flanges extending generally radially from opposite ends of the lower casing half, the first and second upper split-line flanges being joined to the first and second lower split-line flanges, respectively, to thereby join the upper and lower casing halves to one another to form the casing, and at least first and second false flanges spaced opposite one another on the casing, the first false flange extending generally radially from a side of the upper casing half, the second false flange extending generally radially from a side of the lower casing half, each of the first and second false flanges including a split in the false flange's inner diameter so as to allow the casing's hoop stiffness to be adjusted to match the split-line flanges' hoop stiffness and the radius of the load path of the split-line flanges.

9. The casing of claim 8, wherein the split in each of the false flanges has a shape that allow the casing's hoop stiffness to be adjusted to match the split-line flanges' hoop stiffness and the radius of the load path of the split-line flanges.

10. The casing of claim 9, wherein the shape of the split in each of the false flanges is either a straight channel or a keyhole shape.

11. The casing of claim 8, wherein a plurality of false flanges are located symmetrically around the circumference of the casing, each false flange being positioned opposite another false flange.

12. The casing of claim 8, wherein a plurality of false flanges are located asymmetrically around the circumference of the casing.

13. The casing of claim 8, wherein each of the false flanges is sized and/or dimensioned to substantially match the stiffness and thermal mass of the first upper and lower split-line flanges together and/or the second upper and lower split-line flanges together.

14. The casing of claim 8, wherein each false flanges is positioned circumferentially on the casing so that the false flanges and the split-line flanges are spaced equally apart around the casing.

15. A method of controlling distortion in a cylindrical casing, the method comprising the steps of:

providing an upper casing half with first and second upper split-line flanges extending from opposite ends of the upper casing half, providing a lower casing half with first and second lower split-line flanges extending from opposite ends of the lower casing half, joining the first and second upper split-line flanges to the first and second lower split-line flanges, respectively, to thereby join the upper and lower casing halves to one another to form the cylindrical casing, providing a plurality of false flanges extending from the upper and lower casing halves, and providing in each of the false flanges with a split in the false flange's inner diameter to thereby adjust the casing's hoop stiffness to match the hoop stiffness of the split-line flanges and the radius of the load path of the split-line flanges.

16. The method of claim 15, wherein the split in each of the false flanges has a shape that allow the casing's hoop stiffness to be adjusted to match the split-line flanges' hoop stiffness and the radius of the load path of the split-line flanges.

17. The method of claim 15, wherein the shape of the split in each of the false flanges is either a straight channel or a keyhole shape.

18. The method of claim 15, wherein the plurality of flanges are positioned symmetrically around the casing.

19. The method of claim 15, wherein the plurality of flanges are positioned asymmetrically around the casing.

20. The method of claim 15, wherein each of the false flanges is sized and/or dimensioned to substantially match the stiffness and thermal mass of the first upper and lower split-line flanges together and/or the second upper and lower split-line flanges together.

* * * * *